US005827138A

United States Patent [19]

Barrett

[11] Patent Number: 5,827,138

[45] Date of Patent: Oct. 27, 1998

[54] BALL GAME AND BAT FOR USE THEREWITH

[76] Inventor: Ramsay M. Barrett, 97 Coburn Ave., Worcester, Mass. 01604

[21] Appl. No.: 738,010

[22] Filed: Oct. 25, 1996

[51] Int. Cl.[6] ..... A63B 71/00

[52] U.S. Cl. ..... 473/470; 273/118 R; 473/330; 473/558; 473/559; 473/564

[58] Field of Search ..... 473/470, 219, 473/226, 249, 256, 282, 305, 306, 314, 324, 330, 559, 564, 558; 273/118 R, 119 R, 127 RB, 129 K

[56] References Cited

U.S. PATENT DOCUMENTS 196,356 10/1877 Harrington ..... 473/410
1,847,963 3/1932 Hix ..... 273/118 R
3,504,914 4/1970 Bradbury ..... 273/118 R
5,524,895 6/1996 Nakajima ..... 473/249

*Primary Examiner*—William H. Grieb
*Attorney, Agent, or Firm*—Samuels, Gauthier, Stevens & Reppert

[57] ABSTRACT

A game played on either an indoor/outdoor court. The game includes a bat, a game ball and two sets of balls which are of different colors. The bat has a substantially round drive head with which to bat balls. A game ball is hit up the court. Then one player hits their ball up the court and as close to the game ball as possible. The game continues until all the balls are hit. Then the person or team with the ball(s) closest to the game ball scores a point for each ball that rests closer to the game ball than the closest ball of the opposite side or team.

8 Claims, 1 Drawing Sheet

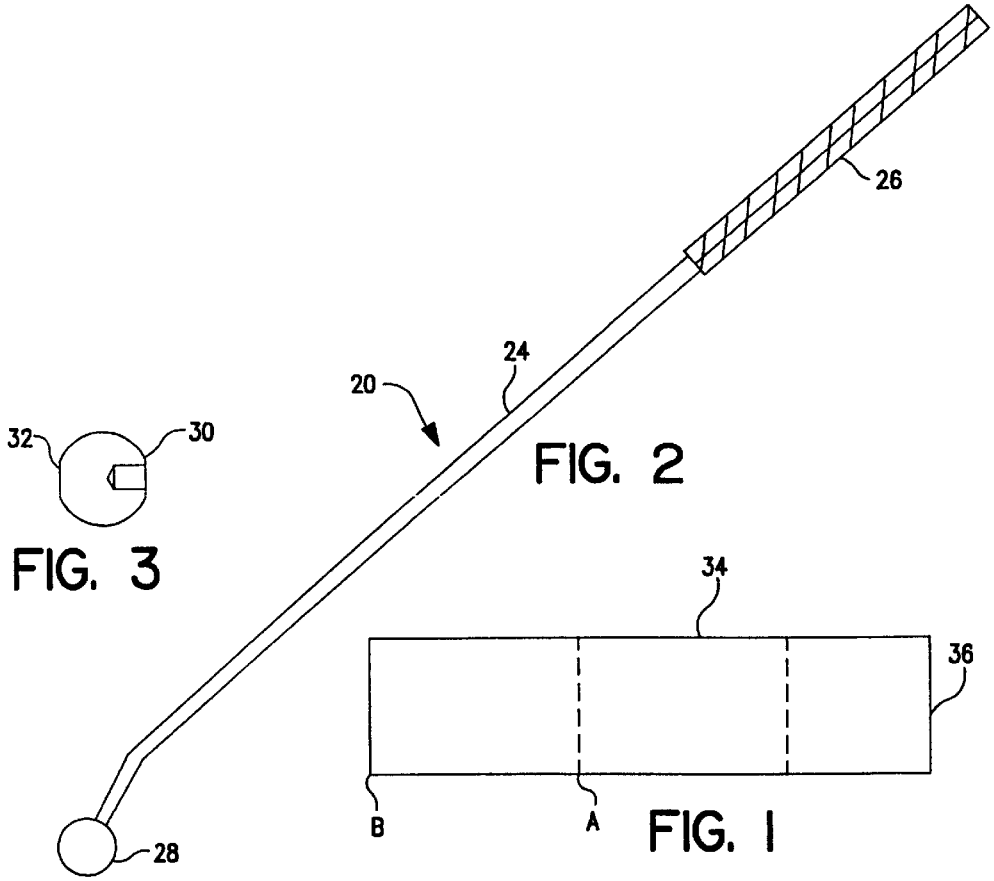
FIG. 2
FIG. 3
FIG. 1
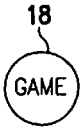
FIG. 4
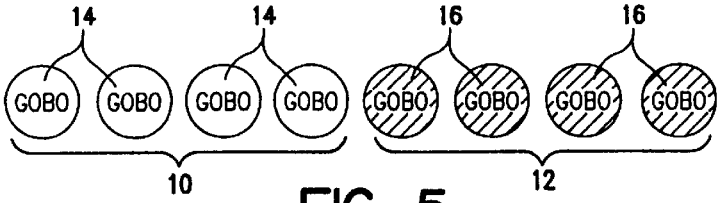
FIG. 5

BALL GAME AND BAT FOR USE THEREWITH

BACKGROUND

This invention relates to an indoor/outdoor game. The game is played on a course and includes a bat, a game ball, and two sets of additional balls.

This game quenches the need for an indoor/outdoor game that will deliver an action packed event regardless of the environment in which the game is played. The objectives of the game is the comprehensive inclusion of all people, and to motivate physical challenge without compromising competitiveness and skill.

It is a further object of the game to bring together and promote its potential for complete family participation.

SUMMARY

In playing the game, it will provide an atmosphere of pro-sports without the use of multiple sporting gear and large acreage.

The components are carefully crafted for comfort & competition. They are admirable and interact well with today's sports and the future.

The game includes a court, balls and a bat. A game ball is batted down the court with the bat and then players bat their respective balls down the court, each trying to place their ball as closest to the game ball as possible. The game may be played with two individuals or teams of players.

BRIEF DESCRIPTION OF DRAWINGS

FIG. 1 is a top view of a typical playing court;

FIG. 2 is a perspective view of a bat;

FIG. 3 is a side view of the drive head for the bat;

FIG. 4 is a side view of a game ball; and

FIG. 5 is a side view of 8 colored balls.

DETAILED DESCRIPTION OF THE EMBODIMENT

Gobo 2000 is a sport for the twenty-first century. It is an indoor/outdoor game for all ages and sexes. It is a great way for an exciting family fun as well as pro-sport. The game can be played with 2 or 4 players, individuals or as a team. Two players play with four balls each and four players play with two balls each.

Expansion: The game may be expanded to 6 or 8 players with the use of additional balls.

Referring now to the figures, the game is played with two sets 10, 12 of four (4) colored 1½" diameter balls 14, 16, see FIG. 5, a perforated game ball 18, see FIG. 4, a bat 20 see FIGS. 2 and 3, FIGS. 5A and 5B.

The two sets of balls 10, 12 are each of different colors. The balls 14, 16 may have a solid core and made from resin, especially a medium density resin to decrease the speed of the balls. The game ball 18 may have a hollow core and be made of plastic. It may be white and should be a different color than those of the two sets of balls 10, 12.

The bat 20 has a shaft 24 with a handle 26 at one end thereof. At the other end is a drive head 28. The drive head 28 is substantially round with two flat surfaces 30, 32 on opposite sides of the drive head as seen in FIG. 3.

The game may be played outdoor on a grass court 34, having a minimum of 16 feet in length and 4 feet in width, or indoors on carpet 34 which is approximately 4 feet by 16 feet, FIG. 1. Rough courts with ditches and uneven grass is encouraged. This enforces a greater skill to score.

The game is begun by tossing a coin to determine which player gets possession of the game ball.

The game starts off by placing the game ball 18 at position 36 of FIG. 1. A player then hits or bats the game ball 18 up the court to a minimum of 10 feet A and a maximum of 16 feet B. Now each team or player must bat their balls to within the closest distance to the game ball.

The first player bats and then the second player must try and beat that play, i.e. get closer to the game ball. If the player fails, then the other teammate must continue to bat until they beat the play or bats all of their balls. Then, the player closest to the game ball will bat their remaining balls. The game continues until all of the balls have been hit. A point is scored by one player or team for every ball of that player or team that is closer to the game ball than the closest one of the other player or team.

The winner gains control of the game ball.

Challenge

Players can hit their opponent balls out of scoring positions or score a direct hit on the game ball to get into a better scoring position. SO THE SAYING IS THE GAME IS NOT OVER UNTIL THE LAST BALL IS PLAYED.

Pro-Sport

Players can enforce their rules if so desired. The game is designed to be entertaining and fun, make a clear judgment, as to which player's ball is closest to the game ball; but if the player's opponent is more comfortable with an exact distance, take out the tape measure.

It is the intent of the game to bring people together for competition and fun.

Rules

Age group recommendation: 5 to 100 years old

Miscue

A Miscue is when a player under hits or bats for a range less than 4 feet. For friendly matches, the player could be allowed to re-hit their ball, but not allowed in pro-sport.

Flyball

A flyball is a game ball that is hit for a distance less than 10 feet or greater than 16 feet at the start of the game. A re-hit is allowable in friendly games not allowed in pro-sport

Scoring

A) Matches are played until one player or team has 16 points. Shorter matches can be introduced.

B) Only one team or player can score in each game.

C) Each player or team can score a maximum of four points per game.

D) A tie breaker can be played if two balls from opposite teams are each equidistant the game ball. The game should be replayed with a 1 point bonus for the team that wins the replay.

E) A perfect game is when a team scores 4 points in one game.

F) A shut out occurs at the start of a game when the player who has control of the game ball hits the game ball up court, then makes the first hit directly on the game ball and remains touching the game ball. The player scores one (1) point and wins by way of a shut out.

What is claimed is:

1. A game apparatus, said game apparatus comprising:

a bat, said bat having a shaft, a handle at one end thereof and a drive head at the opposite end of said shaft, said shaft includes a bend near said head and wherein said head includes two flat surfaces on opposite sides of said head;

a game ball;

a first set of balls;

a second set of balls, such that the first and second sets of balls each have the same number of balls in the respective sets, and wherein the first set of balls are of a different color than the second set of balls, said game is played on a court having demarcations locating a minimum and maximum distance that said game ball must initially be hit.

2. The game apparatus of claim 1, wherein said game ball is hollow.

3. The game apparatus of claim 2, wherein said game ball is plastic.

4. The game apparatus of claim 1, wherein said first and second set of balls are solid.

5. The game apparatus of claim 4, wherein said first and second set of balls are medium density resin.

6. A bat for use in a ball game, said bat comprises:

a shaft having two ends;

a handle at one end of said shaft; and a drive head, said drive head being substantially spherical, said sphere having two flat surfaces on opposite sides thereof, and wherein said shaft includes a bend near said drive head.

7. The bat of claim 6, wherein said head is a solid brass ball.

8. The bat of claim 7, wherein said drive head is of equal size to balls that are to be hit with said bat.

* * * * *